US007585378B2

(12) United States Patent
Odaka et al.

(10) Patent No.: US 7,585,378 B2
(45) Date of Patent: Sep. 8, 2009

(54) METHODS FOR PRODUCING RAW MATERIAL ALLOY FOR RARE EARTH MAGNET, POWDER AND SINTERED MAGNET

(75) Inventors: Tomoori Odaka, Osaka (JP); Yuji Kaneko, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 520 days.

(21) Appl. No.: 10/597,853

(22) PCT Filed: Apr. 27, 2005

(86) PCT No.: PCT/JP2005/008019

§ 371 (c)(1),
(2), (4) Date: Aug. 9, 2006

(87) PCT Pub. No.: WO2005/105343

PCT Pub. Date: Nov. 10, 2005

(65) Prior Publication Data

US 2008/0251159 A1 Oct. 16, 2008

(30) Foreign Application Priority Data

Apr. 30, 2004 (JP) ..... 2004-135656

(51) Int. Cl.
*H01F 1/053* (2006.01)
*H01F 1/057* (2006.01)

(52) U.S. Cl. ..... 148/101; 148/301; 148/302; 148/121

(58) Field of Classification Search ..... None
See application file for complete search history.

(56) References Cited

U.S. PATENT DOCUMENTS 6,403,024 B1 6/2002 Oota et al.

(Continued)

FOREIGN PATENT DOCUMENTS

JP 08-269643 A 10/1996

(Continued)

OTHER PUBLICATIONS

Official Communication issued in the corresponding International Application No. PCT/JP2005/008019, mailed on Nov. 14, 2006.

(Continued)

*Primary Examiner*—John P. Sheehan
(74) *Attorney, Agent, or Firm*—Keating & Bennett, LLP

(57) ABSTRACT

A method of making a material alloy for an R-T-Q based rare-earth magnet according to the present invention includes the steps of: preparing a melt of an R-T-Q based rare-earth alloy, where R is rare-earth elements, T is a transition metal element, Q is at least one element selected from the group consisting of B, C, N, Al, Si and P, and the rare-earth elements R include at least one element $R_L$ selected from the group consisting of Nd, Pr, Y, La, Ce, Pr, Sm, Eu, Gd, Er, Tm, Yb and Lu and at least one element $R_H$ selected from the group consisting of Dy, Tb and Ho; cooling the melt of the alloy to a temperature of 700° C. to 1,000° C. as first cooling process, thereby making a solidified alloy; maintaining the solidified alloy at a temperature within the range of 700° C. to 900° C. for 15 seconds to 600 seconds; and cooling the solidified alloy to a temperature of 400° C. or less as a second cooling process.

15 Claims, 2 Drawing Sheets

U.S. PATENT DOCUMENTS

| | | | | |
|---|---|---|---|---|
| 6,468,365 | B1 | 10/2002 | Uchida et al. | |
| 6,491,765 | B2 | 12/2002 | Okayama et al. | |
| 7,258,751 | B2 * | 8/2007 | Tomizawa et al. | 148/101 |
| 2002/0121315 | A1 * | 9/2002 | Nomura et al. | 148/302 |
| 2004/0163737 | A1 | 8/2004 | Tomizawa et al. | |
| 2005/0016632 | A1 * | 1/2005 | Tomizawa et al. | 148/105 |
| 2005/0028892 | A1 | 2/2005 | Sasaki | |
| 2006/0016515 | A1 * | 1/2006 | Tomizawa et al. | 148/101 |

FOREIGN PATENT DOCUMENTS

| | | | |
|---|---|---|---|
| JP | 2000-188213 | A | 7/2000 |
| JP | 2002-266006 | A | 9/2002 |
| JP | 2003-188006 | A | 7/2003 |
| WO | 02/072900 | A2 | 9/2002 |

OTHER PUBLICATIONS

International Search Report issued in the corresponding International Application No. PCT/JP2005/008019, mailed on Aug. 16, 2005.

* cited by examiner

METHODS FOR PRODUCING RAW MATERIAL ALLOY FOR RARE EARTH MAGNET, POWDER AND SINTERED MAGNET

BACKGROUND OF THE INVENTION

1. Field of the Invention

The present invention relates to a method of making a material alloy for a rare-earth magnet, a method of making a material alloy powder for a rare-earth magnet, and a method for producing a sintered magnet using the rare-earth magnet material alloy powder.

2. Description of the Related Art

A neodymium-iron-boron based magnet has a higher maximum energy product than any of various types of magnets, and is relatively inexpensive. That is why such a magnet has been used more and more often as an important part of an HDD, an MRI or a motor in a broad variety of electronic devices.

A neodymium-iron-boron based magnet is a magnet including $Nd_2Fe_{14}B$ type crystals as its main phase and is sometimes called an "R-T-B based magnet" more generically, where R is a rare-earth element, T is a transition metal element, most of which is Fe but which may also include Ni and Co, and B is boron. However, since B may be partially replaced with an element such as C, N, Al, Si and/or P, at least one element selected from the group consisting of B, C, N, Al, Si and P will be referred to herein as "Q" and a rare-earth magnet, which is usually called a "neodymium-iron-boron based magnet" will be referred to herein as an "R-T-Q based rare-earth magnet" more broadly. In an R-T-Q based rare-earth magnet, $R_2T_{14}Q$ crystal grains form its main phase.

A material alloy powder for an R-T-Q based rare-earth magnet is often made by a process including a first pulverization process step for coarsely pulverizing the material alloy and a second pulverization process step for finely pulverizing the material alloy. For example, in the first pulverization process step, the material alloy is coarsely pulverized to a size of several hundreds of micrometers or less by a hydrogen decrepitation process. In the second pulverization process step, the coarsely pulverized material alloy (coarsely pulverized powder) is finely pulverized to a mean particle size of about several micrometers using a jet mill pulverizer, for example.

The magnet material alloy itself may be made by any of a number of methods, which are roughly classified into the following two types. The first type is an ingot casting process, in which a molten alloy with a predetermined composition is poured into a die and cooled relatively slowly. The second type is a rapid cooling process such as a strip casting process and a centrifugal casting process, in which a molten material alloy with a predetermined composition is rapidly cooled through a contact with a single roller, twin rollers, a rotary disk or a rotary cylindrical die, thereby making a solidified alloy, which is thinner than an ingot cast alloy, from the molten alloy.

In the rapid cooling process, the molten alloy is cooled at a rate of $10^{1\circ}$ C./s to $10^{4\circ}$ C./s. The rapidly cooled alloy made by the rapid cooling process has a thickness of 0.03 mm to 10 mm. The molten alloy starts to be solidified on the surface that has contacted with the chill roller (i.e., a roller contact surface). From the roller contact surface, crystal grows in the thickness direction into the shape of needles. The resultant rapidly cooled alloy has a microcrystalline structure including an $R_2T_{14}Q$ crystalline phase having minor-axis sizes of 3 μm to 10 μm and major-axis sizes of 10 μm to 300 μm and R-rich phases dispersed on the grain boundary of the $R_2T_{14}Q$ crystalline phase (i.e., a phase including a rare-earth element R at a relatively high concentration). The R-rich phases are nonmagnetic phases in which the concentration of the rare-earth element R is relatively high, and has a thickness (which corresponds to the width of the grain boundary) of 10 μm or less.

As the rapidly cooled alloy has been cooled in a shorter time than an alloy made by the conventional ingot casting process (i.e., the ingot cast alloy), the rapidly cooled alloy has a fine structure and has smaller crystal grain sizes. In addition, the crystal grains are distributed finely, the grain boundary has a wide area, and the R-rich phases are distributed thinly over the grain boundary. Such a good distribution of the R-rich phases improves the sinterability. That is why a rapidly cooled alloy has been used more and more often as a material to make an R-T-Q based rare-earth sintered magnet with good properties.

If a rare-earth alloy (especially a rapidly cooled alloy) is coarsely pulverized by a so-called "hydrogen pulverization process", in which the alloy is made to occlude hydrogen gas once (and which will be referred to herein as a "hydrogen decrepitation process"), the R-rich phases present on the grain boundary will react with hydrogen and expand. As a result, the alloy tends to crack from the R-rich phase portions (i.e., grain boundary portions). Therefore, the R-rich phases tend to be exposed on the surfaces of powder particles, which have been obtained by pulverizing the rare-earth alloy by the hydrogen pulverization process. Besides, in the rapidly cooled alloy, the R-rich phases have such small sizes and have been distributed so uniformly that the R-rich phases are exposed on the surface of the hydrogen-pulverized powder particularly easily.

Such a pulverization method using the hydrogen decrepitation process is disclosed in U.S. patent application Ser. No. 09/503,738, for example.

A technique of substituting Dy, Tb, and/or Ho for a portion of a rare-earth element R to increase the coercivity of such an R-T-Q based rare-earth magnet is known. At least one element selected from the group consisting of Dy, Tb and Ho will be referred to herein as "$R_H$".

However, the element $R_H$ that has been added to the R-T-Q based rare-earth magnet material alloy will be present not only in the $R_2T_{14}Q$ phase as the main phase but also in the grain boundary phase substantially uniformly after the molten alloy has been rapidly cooled. The element $R_H$, present in those grain boundary phases, does not contribute to increasing the coercivity, which is a problem.

The high concentration of the element $R_H$ in the grain boundary will decrease the sinterability, which is also a problem. This problem becomes non-negligible if the ratio of the element $R_H$ to the overall material alloy is 1.5 at % or more and gets serious once this ratio has exceeded 2.0 at %.

Also, the grain boundary phase portions of the solidified alloy easily turn into a superfine powder (with particle sizes of 1 μm or less) as a result of a hydrogen decrepitation process and a fine pulverization process. Even if those portions have not changed into the superfine powder, they tend to have exposed powder surfaces. The superfine powder is likely to cause oxidation and firing problems and does affect the sinterability. That is why the superfine powder is usually removed during the pulverization process. A rare-earth element that is exposed on the surface of powder particles with particle sizes of 1 μm or more is oxidized easily and the element $R_H$ is oxidized more easily than Nd or Pr. Thus, the element $R_H$, present in the grain boundary phase of the alloy, produces a chemically stable oxide and tends to get precipitated continuously in the grain boundary phase without substituting for the rare-earth element R in the main phase.

Consequently, portions of the element $R_H$ that are present in the grain boundary phase of a rapidly cooled alloy cannot be used effectively to increase the coercivity. The element $R_H$ is a rare-to-find element and is expensive, too. For that reason, to use valuable natural resources more efficiently and to cut down the manufacturing cost, it is strongly recommended to avoid such a waste of that precious element.

To overcome these problems, Patent Document No. 1 proposes that a rapidly cooled and solidified alloy, made by a strip casting process, be subjected to a heat treatment process at a temperature of 400° C. to 800° C. for 5 minutes to 12 hours to move the heavy rare-earth element from the grain boundary into the main phase and set the concentration of that element higher in the main phase.

Patent Documents Nos. 2 and 3 also disclose that the process of rapidly cooling a molten alloy should be controlled to regulate the structure of the resultant rapidly cooled alloy, not to increase the concentration of Dy in the main phase.

Specifically, Patent Document No. 2 proposes that in order to further reduce the grain size of the rapidly cooled alloy structure, the process of rapidly cooling a molten alloy be divided into the two stages of first cooling and second cooling and that the cooling rates in the respective stages be controlled within particular ranges.

Patent Document No. 3 proposes that just after having been made by getting a molten alloy cooled rapidly by a chill roller, a thin-strip rapidly cooled and solidified alloy be stored in a container to have its temperature controlled. According to the method disclosed in Patent Document No. 3, the average cooling rate is controlled to the range of 10° C./min to 300° C./min when the temperature of the alloy falls from 900° C. to 600° C. during the rapid cooling process, thereby controlling the distribution of the R-rich phases.

Patent Document No. 1: Japanese Patent Application No. 2003-507836,

Patent Document No. 2: Japanese Patent Application Laid-Open Publication No. 8-269643, and Patent Document No. 3: Japanese Patent Application Laid-Open Publication No. 2002-266006.

SUMMARY OF THE INVENTION

However, these conventional techniques have the following drawbacks.

According to the method disclosed in Patent Document No. 1, the rapidly cooled alloy is once cooled to a temperature at which the element does not diffuse anymore (e.g., to room temperature) and then heated in a different furnace from the rapid cooling machine, thereby carrying out the heat treatment process at 400 to 800° C. To conduct the heat treatment process in this manner after the rapid cooling is finished, an additional process of heating the rapidly cooled alloy to the heat treatment temperature is needed, thus complicating the manufacturing process. Besides, the crystal grains will grow excessively and the coercivity will decrease.

Likewise, according to the methods disclosed in Patent Documents Nos. 2 and 3, the grain sizes of the rapidly cooled alloy structure can be reduced and the R-rich phases can be distributed uniformly, but no particular rare-earth element such as Dy can be diffused from the grain boundary into the main phase.

In order to overcome these problems, a primary object of the present invention is to provide a method of producing an R—Fe-Q based rare-earth magnet that can increase the coercivity effectively by concentrating Dy, Tb and Ho in the main phase without complicating the manufacturing process.

A method of making a material alloy for an R-T-Q based rare-earth magnet according to the present invention includes the steps of: preparing a melt of an R-T-Q based rare-earth alloy, where R is rare-earth elements, T is a transition metal element, Q is at least one element selected from the group consisting of B, C, N, Al, Si and P, and the rare-earth elements R include at least one element $R_L$ selected from the group consisting of Nd, Pr, Y, La, Ce, Pr, Sm, Eu, Gd, Er, Tm, Yb and Lu and at least one element $R_H$ selected from the group consisting of Dy, Tb and Ho; cooling the melt of the alloy to a temperature of 700° C. to 1,000° C. as first cooling process, thereby making a solidified alloy; maintaining the solidified alloy at a temperature within the range of 700° C. to 900° C. for 15 seconds to 600 seconds; and cooling the solidified alloy to a temperature of 400° C. or less as a second cooling process.

In one preferred embodiment, the step of maintaining the solidified alloy at a temperature within the range includes the step of decreasing the temperature of the solidified alloy at a temperature decrease rate of 10° C./min or less or the step of increasing the temperature of the solidified alloy at a temperature increase rate of 1° C./min or less.

In another preferred embodiment, the first cooling process includes the step of decreasing the temperature of the melt of the alloy at a cooling rate of $10^{2}$° C./s to $10^{4}$° C./s.

In still another preferred embodiment, the second cooling process includes the step of decreasing the temperature of the solidified alloy at a cooling rate of 10° C./s or more.

In yet another preferred embodiment, the element $R_H$ accounts for at least 5 at % of the rare-earth elements included.

In yet another preferred embodiment, just after the second cooling process is finished, the atomicity ratio of the element $R_H$ included in the $R_2T_{14}Q$ phase of the solidified alloy is higher than that of the element $R_H$ to the overall rare-earth elements.

In yet another preferred embodiment, just after the second cooling process is finished, the atomicity ratio of the element $R_H$ included in the $R_2T_{14}Q$ phase of the solidified alloy is more than 1.1 times as high as that of the element $R_H$ to the overall rare-earth elements.

In yet another preferred embodiment, the rare-earth elements R account for 11 at % to 17 at % of the overall alloy, the transition metal element T accounts for 75 at % to 84 at % of the overall alloy, and the element Q accounts for 5 at % to 8 at % of the overall alloy.

In yet another preferred embodiment, the alloy further includes at least one additional element M that is selected from the group consisting of Ti, V, Cr, Mn, Ni, Cu, Zn, Ga, Zr, Nb, Mo, In, Sn, Hf, Ta, W and Pb.

In yet another preferred embodiment, the first cooling process includes the step of cooling the melt of the alloy with a rotating chill roller.

In yet another preferred embodiment, the step of maintaining includes the step of transferring heat from a member that has been heated to a temperature of 700° C. to 900° C. to the rapidly cooled alloy.

A method of making a material alloy powder for an R-T-Q based rare-earth magnet according to the present invention includes the steps of: decrepitating the R-T-Q based rare-earth magnet material alloy, which has been made by one of the methods described above, by a hydrogen decrepitation process; and pulverizing the R-T-Q based rare-earth magnet material alloy that has been decrepitated.

In one preferred embodiment, the step of pulverizing the R-T-Q based rare-earth magnet includes finely pulverizing the R-T-Q based rare-earth magnet with a high-speed airflow of an inert gas.

A method for producing a sintered magnet according to the present invention includes the steps of preparing the R-T-Q based rare-earth magnet material alloy powder by one of the methods described above and making a compact of the powder, and sintering the compact.

In one preferred embodiment, the step of sintering the compact includes controlling a temperature increase rate at 5° C./min or more when the compact is heated from a temperature of 800° C., at which a liquid phase is produced, to a temperature, at which sintered density reaches a true density, after a dehydrogenation process is finished.

An R-T-B based rare-earth magnet material alloy according to the present invention is made by the method described above and includes a main phase and an R-rich phase. The concentration of the element $R_H$ in a portion of the R-rich phase, which is in contact with an interface between the main phase and the R-rich phase, is lower than that of the element $R_H$ in a portion of the main phase, which is also in contact with the interface, and crystal grains that form the main phase have minor-axis sizes of 3 μm to 10 μm.

According to the present invention, the step of making a solidified alloy by cooling a molten alloy includes the step of maintaining the temperature of the solidified alloy being cooled within the range of 700° C. to 900° C. As a result, a heavy rare-earth element such as Dy can be diffused from the grain boundary into the main phase. Also, according to the present invention, after the cooling process step is finished, there is no need to perform a heat treatment process by heating the solidified alloy, of which the temperature has decreased to around room temperature. Consequently, an alloy that hardly produces an excessive grain growth and that has a very small structure can be obtained and the coercivity can be increased effectively enough by a heavy rare-earth element such as Dy.

DETAILED DESCRIPTION OF PREFERRED EMBODIMENTS

According to the present invention, first, a melt of an R-T-Q based rare-earth alloy, where R is rare-earth elements, T is a transition metal element and Q is at least one element selected from the group consisting of B, C, N, Al, Si and P, is prepared. As the rare-earth elements R, this R-T-Q based rare-earth alloy includes at least one element $R_L$ selected from the group consisting of Nd, Pr, Y, La, Ce, Pr, Sm, Eu, Gd, Er, Tm, Yb and Lu and at least one element $R_H$ selected from the group consisting of Dy, Tb and Ho.

Next, a solidified alloy is made by rapidly cooling (quenching) a molten alloy with such a composition. The present inventors discovered that by performing the "temperature maintaining process step" to be described in detail later in the process step of making a solidified alloy by rapidly cooling such a molten alloy, the element $R_H$ included in the grain boundary phase in the solidified alloy could be moved to the main phase and have an increased concentration in the main phase, thus acquiring the basic idea of the present invention.

Hereinafter, the temperature maintaining process step to be carried out according to the present invention will be described with reference to FIG. 1.

Figure 1:
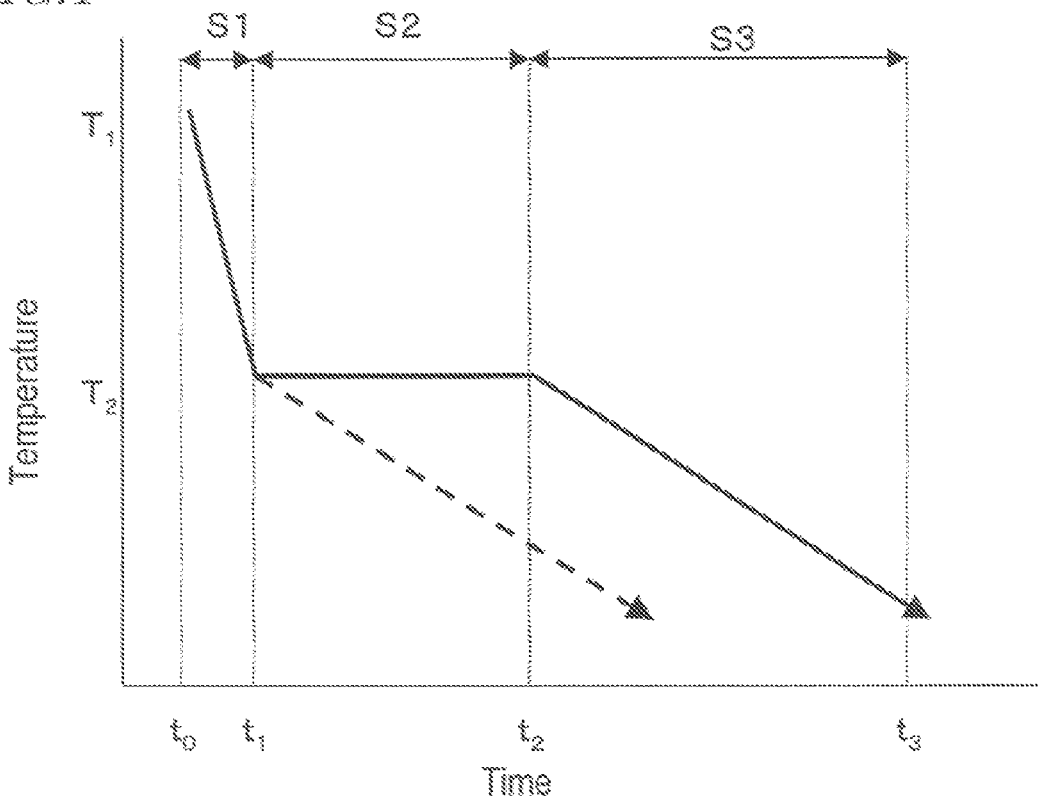
FIG. 1 is a graph schematically showing how the temperature of an alloy being rapidly cooled changes with time.

FIG. 1 is a graph schematically showing how the temperature of an alloy being rapidly cooled changes with time. In this graph, the ordinate represents the temperature of the alloy and the abscissa represents the time that has passed since the rapid cooling process step was started.

In the example shown in FIG. 1, a first cooling process step S1 is carried out on the molten alloy from a time $t_0$ through a time $t_1$, the temperature maintaining process step S2 is carried out from the time $t_1$ through a time $t_2$, and then a second cooling process step S3 is carried out from the time $t_2$ through a time $t_3$.

First, suppose a solidified alloy is made by a normal strip casting process in which a thin-strip solidified alloy is made by bringing a molten alloy into contact with the outer surface of a rotating chill roller. In that case, the molten alloy contacts with the surface of the chill roller at the time to, when the chill roller starts dissipating the heat. Thereafter, the molten alloy is further cooled rapidly while traveling on the rotating chill roller, and then comes out of contact with the surface of the chill roller as a solidified alloy at the time $t_1$. The alloy that has left the chill roller usually has a temperature of about 800° C. to about 1,000° C. According to a conventional strip casting process, the temperature of the solidified alloy that has left the chill roller is decreased by a secondary cooling (such as air cooling) and soon reaches a normal temperature (such as room temperature). In the graph shown in FIG. 1, the dashed line indicates how the temperature changes after the time $t_1$ if the molten alloy has been cooled by a normal strip casting process.

The present invention is characterized by performing the temperature maintaining process step from the time $t_1$ through the time $t_2$ unlike the conventional cooling process. In the graph shown in FIG. 1, the variation in the temperature of the alloy according to the present invention is represented by the solid line. As can be seen from FIG. 1, in the second cooling process step S3 to start at the time $t_2$ when the temperature maintaining process step S2 ends, the alloy temperature is decreased to around room temperature, for example, by natural cooling as in the conventional temperature variation represented by the dashed line.

In the temperature maintaining process step S2 to be carried out in the present invention, the temperature of the alloy is maintained at a predetermined temperature of 700° C. to 900° C. for 15 seconds to 600 seconds. When the temperature maintaining process step S2 is started, the element $R_H$ such as Dy, Tb or Ho would be distributed substantially uniformly either in the grain boundary or in the main phase of the rapidly cooled alloy. However, while the temperature maintaining process step S2 is carried out, a phenomenon that the element $R_H$ such as Dy that has been present in the grain boundary diffuses into the main phase and the element $R_L$ diffuses from the main phase into the grain boundary is observed. At the temperature of 700° C. to 900° C., the main phase in the solidified alloy has been solidified almost fully. On the other hand, the grain boundary has a lot of rare-earth elements and has a low melting temperature, and therefore, at least a portion of the grain boundary is still in a liquid phase, when the element $R_H$ such as Dy would diffuse actively from the grain boundary into the main phase.

Figure 4:
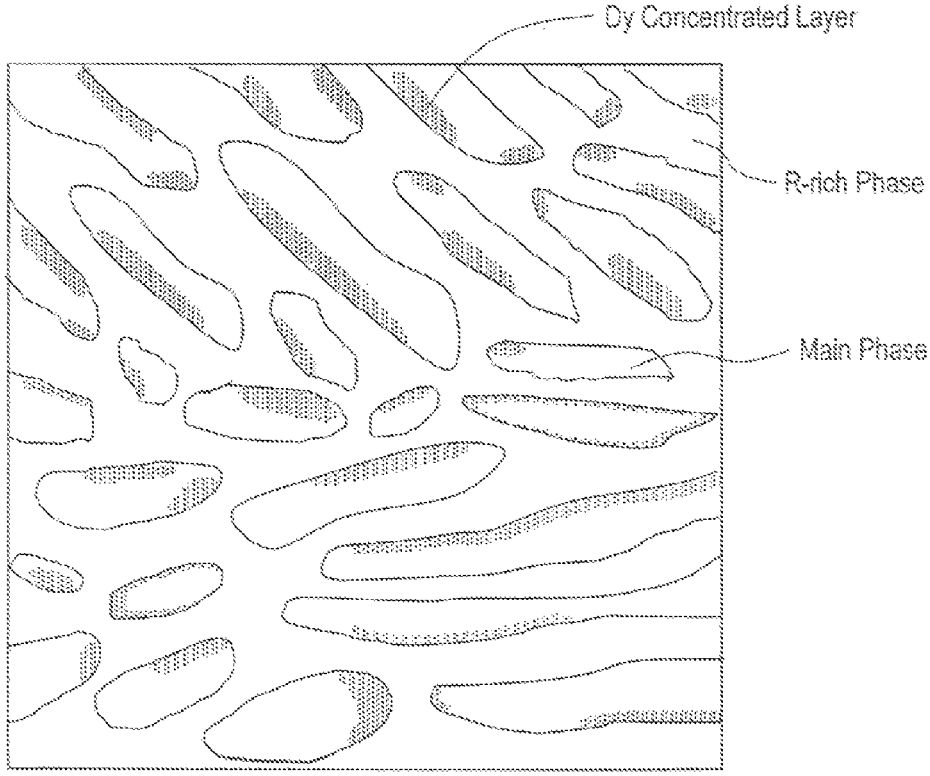
FIG. 4 schematically illustrates the microcrystalline structure of a solidified alloy.

FIG. 4 schematically illustrates the microcrystalline structure of the solidified alloy. The main phase is an $R_2T_{14}Q$ phase, while the grain boundary is an R-rich phase including rare-earth elements R at a high concentration. According to the present invention, the alloy is cooled following the temperature profile represented by the solid line in FIG. 1. That is why a microcrystalline structure, in which the element $R_L$ such as Nd is included more in the grain boundary shown in FIG. 4 but the element $R_H$ such as Dy has a higher concentration in the main phase, can be obtained. As a result, the coercivity can be increased.

By performing the temperature maintaining process step S2 of the present invention, the crystalline phases of the R-T-B based rare-earth magnet material alloy never grow excessively and Dy is diffused from the R-rich phase into the main phase as shown in FIG. 4. Thus, a Dy concentrated layer is formed around the outer edges of the main phase. As can be seen, by performing the temperature maintaining process step S2, the main phase crystal grains of the R-T-B based rare-earth magnet material alloy, which have been made by the rapid cooling process, can maintain a sharp particle size distribution and yet the coercivity can be increased effectively by the Dy concentrated layer.

It should be noted that the Dy concentrated layer does not have to be formed all around the outer edges of the main phase but may be present in only a portion of the outer edges. Even in the latter case, the coercivity can still be increased effectively.

The solidified alloy obtained in this manner is then pulverized into powder by going through a pulverization process. If a hydrogen decrepitation process is performed before the pulverization process, the grain boundary portions tend to be exposed on the surface of the powder. That is why the pulverization process is preferably carried out in an inert gas and the concentration of oxygen in the inert gas is preferably controlled to 1 vol % or less. The reason is that if the concentration of oxygen in the atmospheric gas exceeded 1 vol %, then the powder particles would be oxidized during the fine pulverization process and part of the rare-earth element would be consumed to generate an oxide. If a lot of rare-earth oxides, not contributing to magnetism, were produced in the material alloy powder to make a rare-earth magnet, then the percentage of the $R_2T_{14}Q$ based crystalline phase as the main phase would decrease and the performance of the resultant magnet would decline. In addition, oxides of the element $R_H$ would be produced more easily on the grain boundary and the concentration of the element $R_H$ would decrease in the main phase. Such a fine pulverization process may be carried out using a jet mill, an attritor, a ball mill or any other pulverizer. A pulverization process using a jet mill is disclosed in U.S. patent application Ser. No. 09/851,423, for example.

Hereinafter, preferred embodiments of the present invention will be described in further detail.

First, a melt of an R-T-Q based rare-earth alloy is prepared. As the rare-earth elements R, the molten alloy includes at least one element $R_L$ selected from the group consisting of Nd, Pr, Y, La, Ce, Pr, Sm, Eu, Gd, Er, Tm, Yb and Lu and at least one element $R_H$ selected from the group consisting of Dy, Tb and Ho. In this case, to increase the coercivity sufficiently effectively, the atomicity ratio (i.e., the molar ratio) of the element $R_H$ to the overall rare-earth elements is preferably 5% or more. In a preferred embodiment, the rare-earth elements R account for 11 at % to 17 at % of the overall alloy and the element $R_H$ contributing to increasing the coercivity accounts for at least 10 at % of the overall rare-earth elements R.

The transition metal element T includes Fe as a main ingredient (at least 50 at % of the overall T) but may further include other transition metal elements such as Co and/or Ni as the balance. The transition metal elements T account for 75 at % to 84 at % of the overall alloy.

The element Q includes B as a main ingredient but may further include at least one element selected from the group consisting of C, N, Al, Si and P, which may substitute for B (boron) in a tetragonal $Nd_2Fe_{14}B$ crystal structure. The element Q accounts for 5 at % to 8 at % of the overall alloy.

Besides these main elements, the alloy may further include at least one additional element M that is selected from the group consisting of Ti, V, Cr, Mn, Ni, Cu, Zn, Ga, Zr, Nb, Mo, In, Sn, Hf, Ta, W and Pb.

A melt of the material alloy with such a composition is brought into contact with, and rapidly cooled and solidified by, the surface of the chill roller of a strip caster. In this preferred embodiment, a machine having a configuration such as that shown in FIG. 3 may be used as the strip caster.

Figure 3:
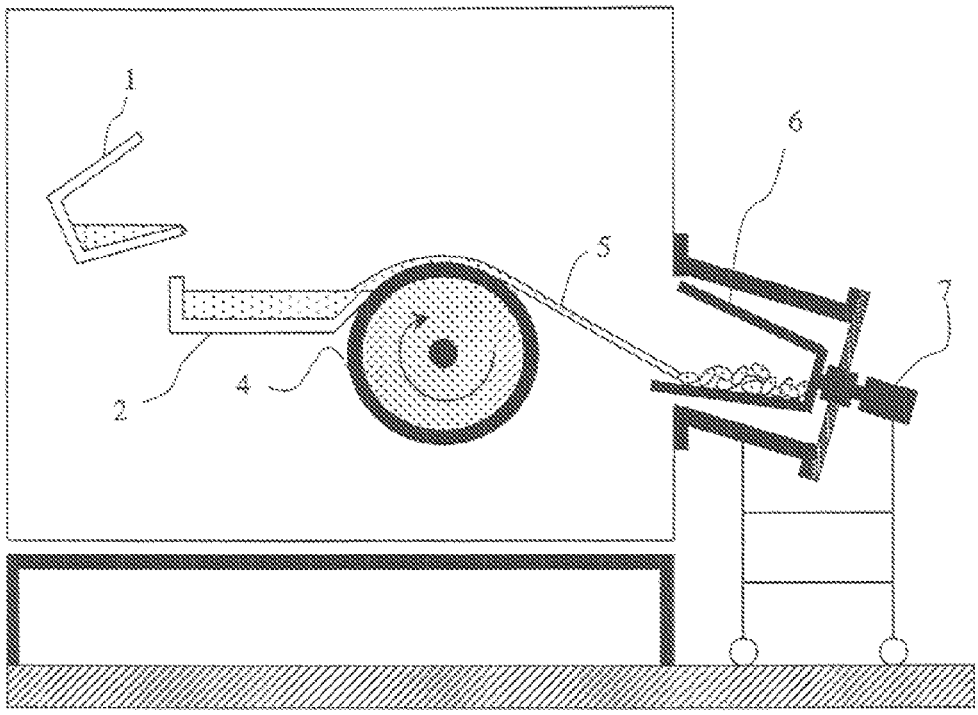
FIG. 3 illustrates a configuration for a machine that can be used effectively to carry out the present invention.

The machine shown in FIG. 3 includes a crucible 1 that is arranged so as to define any tilt angle and reserve a molten alloy, a tundish 2 that receives the molten alloy from the crucible 1, and a chill roller 4 that rapidly quenches the molten alloy, supplied from the tundish 2, while moving it upward.

The machine further includes a drum container 6 for subjecting a thin strip of the solidified alloy 5, which has left the surface of the rotating chill roller 4, to the temperature maintaining process step and a motor 7 for rotating and driving this drum container 6. At least the inner wall portions of the drum container 6 have their temperature maintained within the range of 700° C. to 900° C. by a heater (not shown), for example. By adjusting the output of this heater, the solidified alloy 5 can be maintained at a different temperature. If the motor 7 is driven in the temperature maintaining process step, then the thin strip of the solidified alloy 5 will be split into cast flakes with lengths of about several centimeters. However, those cast flakes will be stirred up in the drum container 6 and therefore subjected to the temperature maintaining process substantially uniformly. When the temperature maintaining process step is finished, those cast flakes of the solidified alloy 5 are collected from the drum container 6. After that, the temperature of the flakes is further decreased by letting them be cooled naturally. Once collected from the drum container 6, the solidified alloy 5 is preferably cooled at as high a rate as possible. That is why a cooling gas (e.g., nitrogen gas) may be blown against the alloy.

If the present invention is carried out by using the machine shown in FIG. 3, the first cooling process step begins when the molten alloy contacts with the surface of the chill roller 5 and continues until the alloy leaves the surface of the chill roller 5. The first cooling process step may be performed for about 0.1 seconds to about 10 seconds. In the first cooling process step, the cooling rate is preferably controlled to the range of $10^{2}$° C./s to $10^{4}$° C./s by adjusting the rotational velocity (i.e., the surface peripheral velocity) of the chill roller within an appropriate range (of 1 m/s to 3 m/s, for example). In the first cooling process step, the temperature of the solidified alloy should not be decreased excessively. This is because such an excessive decrease would require an extra heating process step to raise the temperature to a level that is high enough to carry out the temperature maintaining process step after that. For that reason, in the first cooling process step, the temperature of the alloy is preferably decreased to the range of 700° C. to 1,000° C.

After the first cooling process step, the temperature maintaining process step is carried out while the solidified alloy 5 is still stored in the drum container 6. In the example shown in FIG. 1, the temperature maintaining process step is started as soon as the first cooling process step is finished at the time $t_1$. However, if the machine such as that shown in FIG. 3 is used, the start of the temperature maintaining process step is delayed by the amount of time it takes for the solidified alloy 5 that has left the chill roller 5 to reach the drum container 6. If the start of the temperature maintaining process step is delayed in this manner, then the temperature of the solidified alloy 5 decreases in the meantime. Nevertheless, there will be no problem unless the temperature decreases to less than 700° C. For example, if the temperature setting is 800° C., the temperature of the solidified alloy 5 may have decreased to 750° C. just before the temperature maintaining process step is started. In that case, at least during the initial stage of the temperature maintaining process step, the solidified alloy 5 is heated to somewhere between 750° C. and 800° C. by the drum container 6. Even so, the element $R_H$ such as Dy still diffuses from the grain boundary into the main phase and the coercivity can also be increased effectively. Also, since the temperature maintaining process step is performed for as short as 600 seconds or less, the crystal grains will not grow excessively during this process step.

As can be seen, according to the present invention, the "temperature maintaining process" refers to not only a process of maintaining the temperature of the solidified alloy exactly at a constant level but also to a process of making the alloy pass through the temperature range of 700° C. to 900° C. in a longer time by lowering the cooling rate intentionally compared to natural cooling for a predetermined period of time during the cooling process.

Generally speaking, a solidified alloy that has been made by a strip casting process, for example, has its heat dissipated through either exposure to the air atmosphere or contact with a transport member after having left the chill roller. That is why to perform the temperature maintaining process step of the present invention, heat needs to be transferred to the solidified alloy against such natural cooling (or heat dissipation). In this sense, the "temperature maintaining process step" of the present invention works as a sort of heat treatment process to be carried out during the cooling process.

Figure 2:
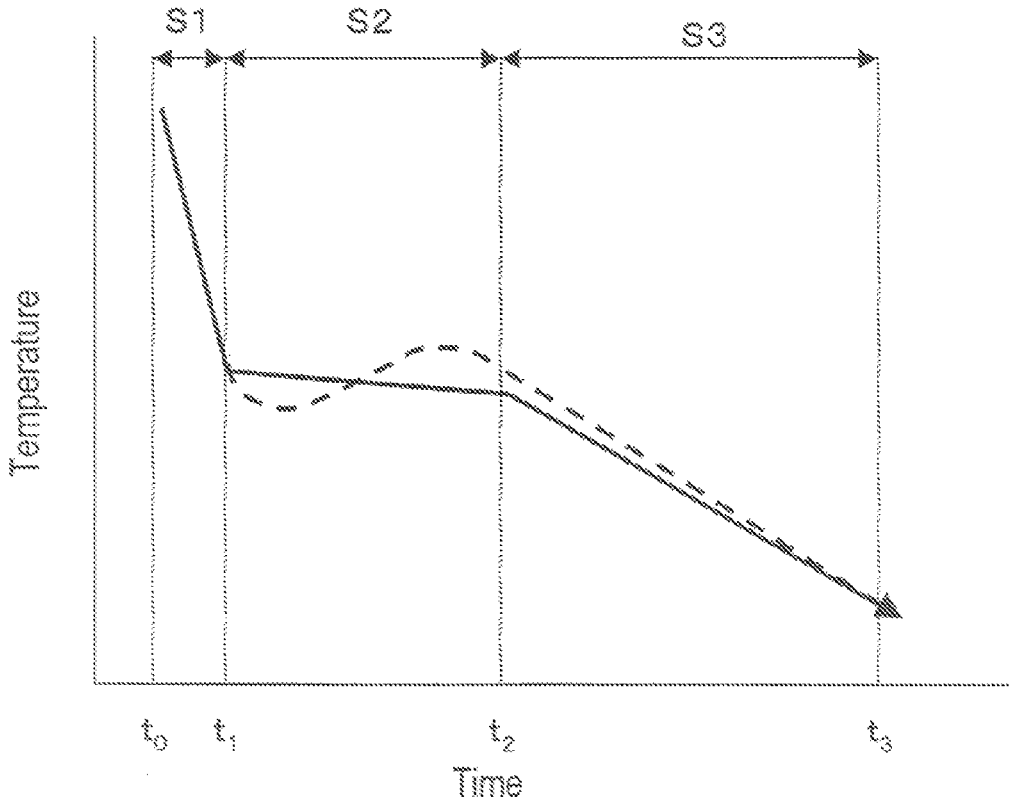
FIG. 2 is a graph schematically showing how the temperature of an alloy being rapidly cooled changes with time in a preferred embodiment of the present invention.

Also, even if one tries to keep the temperature of the solidified alloy constant, some temperature variations are actually inevitable. For example, even when the temperature either falls gently at a temperature decrease rate of 10° C./min or less or rises very slightly at a temperature increase rate of 1° C./min or less, the temperature of the alloy still can be regarded as being kept substantially constant, compared to the normal cooling process. FIG. 2 schematically shows an example in which the alloy temperature falls gradually (as indicated by the solid line) and an example in which the temperature sometimes increases and sometimes decreases (as indicated by the dashed curve) in the temperature maintaining process step S2. In any of these cases, the element $R_H$ such as Dy can also be diffused from the grain boundary into the main phase and the coercivity can be increased, too.

If the temperature maintaining process step were carried out for too long a time, then crystal grains could grow excessively and the coercivity might decrease. That is why the temperature is preferably kept for at least 15 seconds but not more than 600 seconds.

As a result of such a temperature maintaining process step, at least one element $R_H$ selected from the group consisting of Dy, Tb and Ho has an increased concentration in the main phase. The temperature at which the alloy is maintained may be selected arbitrarily within the range of 700° C. to 900° C. as described above, but is preferably set to be about 700° C. to about 800° C.

In the second cooling process step to be carried out after the temperature maintaining process step is finished, the solidified alloy is preferably cooled to a normal temperature (i.e., around room temperature) at a cooling rate of 10° C./s or more. By cooling the alloy at a relatively high cooling rate, the growth of the crystal grains can be reduced sufficiently. The second cooling process step may sometimes be achieved by natural cooling as a result of exposure to the atmospheric gas. Alternatively, the cooling process may be performed intentionally either by blowing a cooling gas against the solidified alloy or bringing the alloy into contact with some cooling member.

This series of process steps is preferably carried out in either a vacuum or an inert gas atmosphere. In the machine shown in FIG. 3, the first cooling process step, temperature maintaining process step and second cooling process step are carried out in a chamber that is shut off from the air. In the latter half of the second cooling process step, however, the temperature of the solidified alloy 5 will have been decreased to a rather low level. Thus, the quality of the alloy will not be debased due to oxidation, for example, even when exposed to the air. That is why part or all of the second cooling process step may be performed outside of the chamber.

It should be noted that the temperature maintaining process step does not have to be carried out by using the machine such as that shown in FIG. 3 but may also be performed by any other method. For example, the temperature maintaining process step may be carried out while the rapidly cooled alloy that has left the chill roller of the strip caster is being transported. In that case, a heating section (i.e., a heater) may be arranged on the transport path to reduce the natural heat dissipation of the solidified alloy that has left the chill roller and is being transported.

In the rapidly cooled alloy (i.e., strip cast alloy) that has been made in this manner, an $R_2T_{14}Q$ phase, where R is a rare-earth element, T is a transition metal element and Q is at least one element selected from the group consisting of B, C, N, Al, Si and P, has been produced as a main phase. The $R_2T_{14}Q$ phase (which is main phase crystal grains) is dendritic crystals with an average minor-axis size of 3 μm to 10 μm and a major-axis size of 10 μm to 300 μm.

In the solidified alloy that has just gone through the second cooling process step (i.e., as-spun alloy), the concentration of the element $R_H$ in the $R_2T_{14}Q$ phase as the main phase is higher than in the other phases (such as the grain boundary phase). That is to say, the element $R_H$ has been concentrated in the main phase successfully.

This means that by performing the temperature maintaining process step, the element $R_H$ that was present in the grain boundary phase portions when the first cooling process step was finished has moved into the $R_2T_{14}Q$ phase as the main phase and has an increased concentration there. In this manner, a solidified alloy, in which the concentration of the element $R_H$ is higher in the $R_2T_{14}Q$ phase than in the other phases, can be obtained at last. In the rapidly cooled alloy, the dendritic gap has hardly changed even after the temperature maintaining process step. Accordingly, the minor-axis size of the $R_2T_{14}Q$ phase has hardly changed and still falls within the range of 3 μm to 10 μm. Even if the dendritic crystals has grown, their growth rate will be a matter of 1 to 2 μm in the minor-axis direction.

According to the present invention, the method of diffusing Dy by heating again a rapidly cooled alloy that has been cooled to around room temperature once is not adopted. Consequently, the excessive growth of crystal grains that would be caused by such a heating process can be minimized and the effect of getting the coercivity increased by a rare-earth element such as Dy can be enhanced effectively.

Next, after the solidified alloy has been decrepitated by the hydrogen decrepitation process as described above, the alloy is pulverized into a fine powder using a pulverizer such as a jet mill. The dry powder thus obtained may have a mean particle size (FSSS particle size) of 3.0 μm to 4.0 μm, for example. The jet mill pulverizes the material alloy with a high-speed airflow of an inert gas to which a predetermined amount of oxygen has been introduced. The concentration of oxygen in the inert gas is preferably controlled so as not to exceed 1 vol %, more preferably to 0.1 vol % or less.

According to the present invention, the concentration of oxygen in the atmosphere is controlled during the pulverization process in this manner so as to prevent the element $R_H$, which has been once moved from the grain boundary phase into the main phase, from moving or precipitating into the grain boundary portions again due to oxidation. If a lot of oxygen were included in a powder, then the heavy rare-earth element $R_H$ such as Dy, Tb or Ho would bond to oxygen and produce a more chemically stable oxide more often than not. In the alloy structure adopted in the present invention, oxygen is distributed more profusely in the grain boundary phase than in the main phase. That is why the element $R_H$ in the main phase would diffuse into the grain boundary phase again and be consumed there to produce an oxide. Once the element $R_H$ has gone out of the main phase in this manner, the coercivity cannot be increased sufficiently anymore. For that reason, the oxidation of the powder is preferably minimized appropriately in the pulverization process and in the sintering process to be described next.

Next, the powder is compacted into a desired shape by using a powder press machine under an aligning magnetic field. Then, the powder compact thus obtained is sintered within an inert gas atmosphere at a pressure of $10^{-4}$ Pa to $10^{6}$ Pa. By performing the sintering process in such an atmosphere in which the oxygen concentration is controlled to a predetermined level or less, the concentration of oxygen in the resultant sintered compact (or sintered magnet) is preferably controlled to 0.3 mass % or less.

The sintering temperature is preferably set so as to prevent Dy, having had an increased concentration in the main phase, from diffusing during the long sintering process. More specifically, the rate of increasing the temperature from 800° C., at which a liquid phase is produced, to a temperature at which the sintered density reaches a true density is preferably set within the range of 5° C./min to 50° C./min. Then, it is possible to prevent Dy, having an increased concentration in the main phase of the solidified alloy that has been pulverized into a powder, from diffusing into the R-rich phase again by maintaining the temperature for that amount of time.

The rapidly cooled alloy that has been coarsely pulverized into a powder by the hydrogen decrepitation process includes hydrogen. Thus, to remove that hydrogen from the alloy powder, the rapidly cooled alloy may be maintained at a temperature of 800° C. to 1,000° C. (e.g., 900° C.) for 30 minutes to 6 hours before subjected to the sintering process. If such a dehydrogenation process is carried out, the heating process at the temperature increase rate will be performed after the dehydrogenation process is finished.

If the temperature is increased for the purpose of sintering after the dehydrogenation process has been carried out by keeping the temperature within the range of 800° C. to 1,000° C. the temperature increase rate is preferably set within the range of 5° C./min to 50° C./min. Then, the grain growth due to the sintering process can be reduced. As a result, it is also possible to minimize the decrease in the coercivity that has been once increased by the temperature maintaining process step.

Optionally, a re-heating process may be carried out at a temperature of 400° C. to 900° C. after the sintering process. By performing such a re-heating process, the grain boundary phases can be controlled just as intended and the coercivity can be further increased.

EXAMPLES AND COMPARATIVE EXAMPLES

First, a melt of an alloy, having a composition including 22 mass % of Nd, 6.0 mass % of Pr, 3.5 mass % of Dy, 0.9 mass % of Co, 1.0 mass % of B and Fe as the balance (and very small amounts of inevitably contained impurities), was rapidly cooled by a single roller strip casting process, thereby making a solidified alloy having the composition described above.

The melt had a temperature of 1,350° C. just before subjected to the rapid cooling process and the roller had a surface peripheral velocity of 70 m/min. In the first cooling process step, the temperature of the solidified alloy was decreased to about 700° C. to about 800° C. by using a strip caster such as that shown in FIG. 3. Next, the alloy was subjected to the temperature maintaining process step using the drum container 6 shown in FIG. 3 under the conditions specified in the following Table 1 and then to the second cooling process step to cool it to room temperature.

TABLE 1

| Sample No. | Temperature maintaining process |
|---|---|
| 1 (example) | 800° C. × 40 seconds |
| 2 (example) | 700° C. × 120 seconds |
| 3 (example) | 700° C. × 240 seconds |
| 4 (comparative example) | NA |

Sample No. 4 representing a comparative example was not subjected to temperature maintaining process step but cooled monotonically and continuously to room temperature.

These Samples Nos. 1 to 4 of solidified alloys obtained in this manner were subjected to a line analysis using an electron probe microanalyzer (EPMA), which is designed to detect a characteristic X-ray by irradiating an object with an electron beam. As a result, the present inventors confirmed that the concentration of Dy was higher in the main phase than in the grain boundary phase and that the concentrations of Nd and Pr were higher in the grain boundary phase than in the main phase. The magnetic properties of the alloy were also measured with a BH tracer. The results are shown in the following Table 2:

TABLE 2

| Sample No. | $B_r$ (kG) | $H_{cJ}$ (kOe) | $(BH)_{max}$ (MGOe) |
|---|---|---|---|
| 1 (example) | 13.1 | 20.5 | 41.0 |
| 2 (example) | 13.1 | 20.1 | 41.0 |
| 3 (example) | 13.1 | 20.3 | 41.0 |
| 4 (comparative example) | 13.1 | 19.5 | 41.0 |

As can be seen from Table 2, Samples Nos. 1 to 3 had coercivities $H_{cJ}$ of 20.1 kOe to 20.5 kOe, while Sample No. 4 had a coercivity $H_{cJ}$ of 19.5 kOe. In this manner, the present inventors confirmed that the coercivities $H_{cJ}$ of the specific examples of the present invention were higher than that of the comparative example by as much as 5% at most.

In these examples of the present invention, the concentration of oxygen during the fine pulverization process was controlled within an appropriate range as described above. Consequently, the diffusion of Dy into the grain boundary can be minimized and yet the coercivity could be increased during the sintering process.

According to the present invention, an element $R_H$, added for the purpose of increasing the coercivity, can have an increased concentration in the main phase by performing a temperature maintaining process step while a molten alloy is being cooled. Thus, the coercivity can be increased with such a rare and expensive heavy rare-earth element used effectively and without performing any special heat treatment process separately.

The invention claimed is:

1. A method of making a material alloy for an R-T-Q based rare-earth magnet, the method comprising the steps of:

(a) preparing a melt of an R-T-Q based rare-earth alloy, where R is rare-earth elements, T is a transition metal element, Q is at least one element selected from the group consisting of B, C, N, Al, Si and P, and the rare-earth elements R include at least one element $R_L$ selected from the group consisting of Nd, Pr, Y, La, Ce, Pr, Sm, Eu, Gd, Er, Tm, Yb and Lu and at least one element $R_H$ selected from the group consisting of Dy, Tb and Ho;

(b) cooling the melt of the alloy to a temperature of 700° C. to 1,000° C. as first cooling process, thereby making a solidified alloy;

(c) maintaining the solidified alloy at a temperature within the range of 700° C. to 900° C. for 15 seconds to 600 seconds; and (d) cooling the solidified alloy of step (c) to a temperature of 400° C. or less as a second cooling process.

2. The method of claim 1, wherein the step of maintaining the solidified alloy at a temperature within the range includes the step of decreasing the temperature of the solidified alloy at a temperature decrease rate of 10° C./min or less or the step of increasing the temperature of the solidified alloy at a temperature increase rate of 1° C./min or less.

3. The method of claim 1, wherein the first cooling process includes the step of decreasing the temperature of the alloy at a cooling rate of $10^{2}$° C./s to $10^{4}$° C./s.

4. The method of claim 1, wherein the second cooling process includes the step of decreasing the temperature of the alloy at a cooling rate of 10° C./s or more.

5. The method of claim 1, wherein the element $R_H$ accounts for at least 5 at % of the rare-earth elements included.

6. The method of claim 1, wherein just after the second cooling process is finished, the atomic ratio of the element $R_H$ included in the $R_2T_{14}Q$ phase of the solidified alloy is higher than that of the element $R_H$ to the overall rare-earth elements.

7. The method of claim 1, wherein just after the second cooling process is finished, the atomic ratio of the element $R_H$ included in the $R_2T_{14}Q$ phase of the solidified alloy is more than 1.1 times as high as that of the element $R_H$ to the overall rare-earth elements.

8. The method of claim 1, wherein the rare-earth elements R account for 11 at % to 17 at % of the overall alloy, and wherein the transition metal element T accounts for 75 at % to 84 at % of the overall alloy, and wherein the element Q accounts for 5 at % to 8 at % of the overall alloy.

9. The method of claim 1, wherein the alloy further includes at least one additional element M that is selected from the group consisting of Ti, V, Cr, Mn, Ni, Cu, Zn, Ga, Zr, Nb, Mo, In, Sn, Hf, Ta, Wand Pb.

10. The method of claim 1, wherein the first cooling process includes the step of cooling the melt of the alloy with a rotating chill roller.

11. The method of claim 1, wherein the step of maintaining includes the step of transferring heat from a member that has been heated to a temperature of 700° C. to 900° C. to the rapidly cooled alloy.

12. A method of making a material alloy powder for an R-T-Q based rare-earth magnet, the method comprising the steps of:

decrepitating the R-T-Q based rare-earth magnet material alloy, which has been made by the method of claim 1, by a hydrogen decrepitation process; and pulverizing the R-T-Q based rare-earth magnet material alloy that has been decrepitated.

13. The method of claim 12, wherein the step of pulverizing the R-T-Q based rare-earth magnet includes finely pulverizing the R-T-Q based rare-earth magnet with a high-speed airflow of an inert gas.

14. A method for producing a sintered magnet, the method comprising the steps of preparing the R-T-Q based rare-earth magnet material alloy powder by the method of claim 12 and making a compact of the powder, and sintering the compact.

15. The method of claim 14, wherein the step of sintering the compact includes controlling a temperature increase rate at 5° C./min or more when the compact is heated from a temperature of 800° C., at which a liquid phase is produced, to a temperature, at which sintered density reaches a true density.

* * * * *